US006719175B2

(12) United States Patent
Mackenzie et al.

(10) Patent No.: US 6,719,175 B2
(45) Date of Patent: Apr. 13, 2004

(54) DRAFT SYSTEM FOR BEVERAGES

(75) Inventors: Randall A. Mackenzie, Cumberland, RI (US); Keith M. Crawford, Oviedo, FL (US)

(73) Assignee: Island Oasis Frozen Cocktail Co., Inc., Walpole, MA (US)

( * ) Notice: Subject to any disclaimer, the term of this patent is extended or adjusted under 35 U.S.C. 154(b) by 1 day.

(21) Appl. No.: 10/096,528

(22) Filed: Mar. 7, 2002

(65) Prior Publication Data

US 2003/0024952 A1 Feb. 6, 2003

Related U.S. Application Data

(60) Provisional application No. 60/273,849, filed on Mar. 7, 2001.

(51) Int. Cl.[7] ..... B65D 83/00
(52) U.S. Cl. ..... 222/399; 222/335; 222/372
(58) Field of Search ..... 222/190, 318, 222/335, 372, 399

(56) References Cited

U.S. PATENT DOCUMENTS

| | | | | | |
|---|---|---|---|---|---|
| 3,240,395 | A | * | 3/1966 | Carver | 222/129.1 |
| 3,428,218 | A | | 2/1969 | Coja | 222/23 |
| 3,675,820 | A | | 7/1972 | Newberry et al. | 222/76 |
| 3,727,799 | A | | 4/1973 | Nixon | 222/129.4 |
| 3,777,937 | A | | 12/1973 | Buck | 222/70 |
| 3,880,330 | A | | 4/1975 | Leas et al. | 222/136 |
| 3,884,391 | A | | 5/1975 | Pauliukonis | 222/129.4 |
| 3,940,019 | A | | 2/1976 | Kross et al. | 222/30 |
| 4,162,028 | A | | 7/1979 | Reichenberger | 222/129.4 |
| 4,304,736 | A | * | 12/1981 | McMillin et al. | 261/35 |
| 4,625,525 | A | | 12/1986 | Bradbury et al. | 62/330 |
| 4,901,539 | A | | 2/1990 | Garber et al. | 62/306 |
| 4,927,567 | A | * | 5/1990 | Rudick | 261/35 |
| 5,033,644 | A | | 7/1991 | Tentler | 222/57 |
| 5,706,661 | A | | 1/1998 | Frank | 62/70 |
| 5,731,981 | A | | 3/1998 | Simard | 364/465 |
| 5,960,701 | A | | 10/1999 | Reese et al. | 99/275 |
| 6,138,724 | A | * | 10/2000 | Rivera et al. | 141/369 |
| 6,196,422 | B1 | * | 3/2001 | Tuyls et al. | 222/129.1 |
| 6,543,646 | B2 | * | 4/2003 | Gibson | 222/129.1 |

* cited by examiner

*Primary Examiner*—Gene Mancene
*Assistant Examiner*—Melvin Cartagena
(74) *Attorney, Agent, or Firm*—Foley Hoag LLP

(57) ABSTRACT

A system for dispensing beverages, in particular for dispensing mixed drinks can be configured to be implemented in conjunction with existing draft systems, for example, draft systems for dispensing beer and the like. Pumps used to dispense the beverages can be powered by the pressurized gas used with the existing draft system. A dual pump system may be used wherein one pump can circulate or mix the beverage within its storage container, while the other pump can pump the beverage for dispensing from a tap.

18 Claims, 4 Drawing Sheets

DRAFT SYSTEM FOR BEVERAGES

RELATED APPLICATIONS

This application claims priority to, and incorporates by reference, the entire disclosure of U.S. Provisional Patent Application No. 60/273,849, filed on Mar. 7, 2001.

BACKGROUND

Methods of dispensing beverages are well known in the art. In a draft dispensing system, a beverage, such as a beer or ale, may be dispensed from a remote beverage container through a length of tubing to a spigot that may be open or closed by a draft handle. Pressurized gas, such as nitrogen or carbon dioxide, from a pressurized gas source is delivered to the beverage container to pressurize the beverage container. When the spigot is opened, a pressure regulator at the beverage container allows the beverage in the container to flow into the tubing and out the spigot. Other systems for dispensing beverages may utilize the pressurized gas to both carbonate and dispense the beverage.

Some beverages, which may typically consist of mixtures of ingredients, may require agitation to maintain the proper consistency of the mixture and to prevent separation of the ingredients. Dispensing systems for such beverages may include pumping systems that continuously circulate the beverage to maintain consistency. The pumping system may be powered from a source separate from the pressurized gas of a draft system, as the continuous pumping can quickly deplete the pressurized gas supply if used to power the beverage circulation system.

SUMMARY

A system for dispensing a beverage from a tap may comprise a dispensing pump in fluid communication with the source of the beverage and the tap, wherein opening the tap operates the dispensing pump to pump the beverage from the source to the tap; and a mixing pump in fluid communication with the source of the beverage operable to circulate the beverage from the source, through the mixing pump and back to the source, wherein operation of the dispensing pump operates the mixing pump. The pumps may be operable by pressurized gas from a pressurized gas source and exhaust gas from the dispensing pump may be fed to the mixing pump to operate the mixing pump. A regulator may control the pressure of the pressurized gas seen at the mixing pump and the dispensing pump. The pressurized gas source may be part of a draft system for dispensing additional beverages.

A shut off valve may be disposed between the dispensing pump and the tap so as to stop the operation of the dispensing pump and the mixing pump when the beverage in the source falls below a predetermined level. The shut off valve may include a bypass between the shut off valve and the source of the beverage. When the bypass is activated, beverage may flow from the shut off valve to the beverage source causing operation of the dispensing pump and the mixing pump.

The system may include a bleed line disposed between the dispensing pump and the tap to provide a controlled flow from an output port of the dispensing pump to the beverage source. The controlled flow can lower a pressure at the output port of the dispensing pump to allow periodic operation of the dispensing pump to compensate for the pressure drop. A needle valve may be used to provide the controlled flow and a filter can be disposed upstream of the needle valve to minimize clogging of the needle.

BRIEF DESCRIPTION OF THE DRAWINGS

The following figures depict certain illustrative embodiments in which like reference numerals refer to like elements. These depicted embodiments are to be understood as illustrative and not as limiting in any way.

DETAILED DESCRIPTION OF CERTAIN ILLUSTRATED EMBODIMENTS

Figure 1:
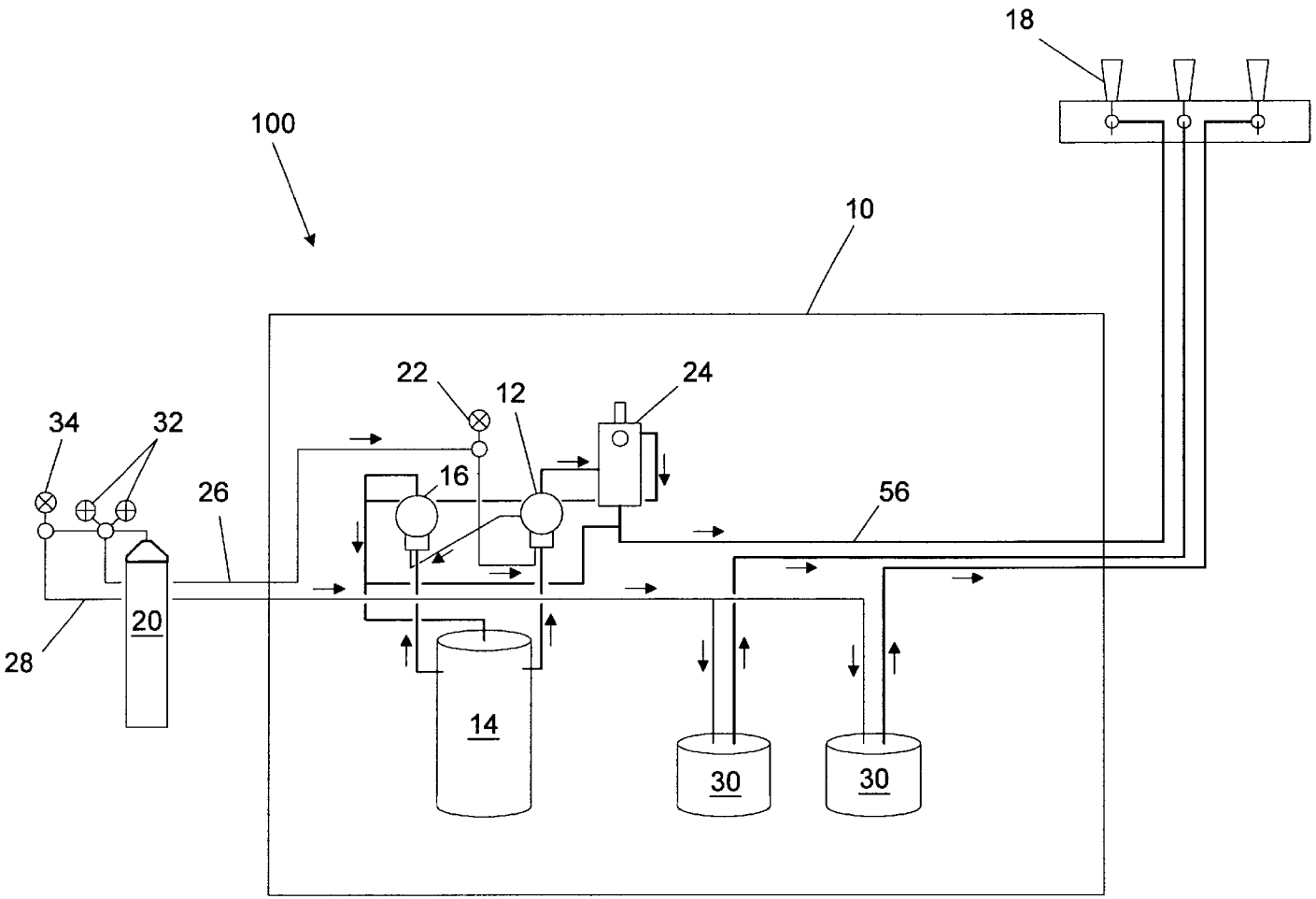
FIG. 1 is a schematic representation of a pressurized gas beverage dispensing system with dual regulators.

Referring now to FIG. 1, there is illustrated a system 100 for dispensing beverages, in particular for dispensing mixed drinks, that may be used in conjunction with a pressurized gas dispensing system, or draft system. The beverages may typically be refrigerated and may require periodic mixing to maintain proper consistency of the beverages, as noted previously. The dispensing systems as disclosed herein may be configured to be implemented in conjunction with existing draft systems, for example, draft systems for dispensing beer and the like. In the embodiments discussed herein, the pump(s) used to dispense the beverages can be powered by the pressurized gas used to dispense or carbonate beverages associated with an existing draft system. The beverage may be stored in a refrigerated compartment 10 used to maintain the temperature for the beverages of the existing draft system.

As shown in FIG. 1, the system 100 may include a dispensing pump 12 for dispensing a beverage stored in a storage tank 14 and a mixing pump 16 for mixing or agitating the beverage in the storage tank. Dispensing pump 12 can operate in conjunction with tap or spigot 18, through which the beverage may be dispensed. Pressurized gas, such as air, nitrogen or carbon dioxide, from a pressurized gas source 20 can be supplied to the dispensing pump 12 and to the mixing pump 16 to power the pumps by moving a piston, diaphragm, or other mechanism in the pump as is known in the art. The pumps 12 and 16 may be chosen from commercially available pumps designed for pumping of pulp type products and to operate on pressurized gas, such as air driven pump model 166-200, as manufactured by Shurflo of Santa Anna, Calif. A gas regulator 22 can be provided to regulate the pressure of the gas supplied to the pumps. The draft system 100 may also optionally include a shut-off valve 24 that operates to shut down the pumps when the beverage within the storage tank 14 drops below a predetermined level, thus preventing air from entering the system 100 and preventing damage to the pumps 12 and 16. The shut-off valve 24 may be chosen from commercially available valves designed for the operation as described herein.

In the embodiment illustrated in FIG. 1, the pressurized gas can be supplied to the pumps 12 and 16 from the gas source 20 along a line 26 separate from the line 28 supplying additional beverage containers 30, e.g., beer kegs. A separate regulator station 32 for the pumps 12 and 16 can thus be provided at the gas source 20 in addition to the regulator station 34 used for the additional beverage containers 30. The gas regulator 22 and regulators at stations 32 and 34 may be known, commercially available products for use in such draft systems.

Figure 2:
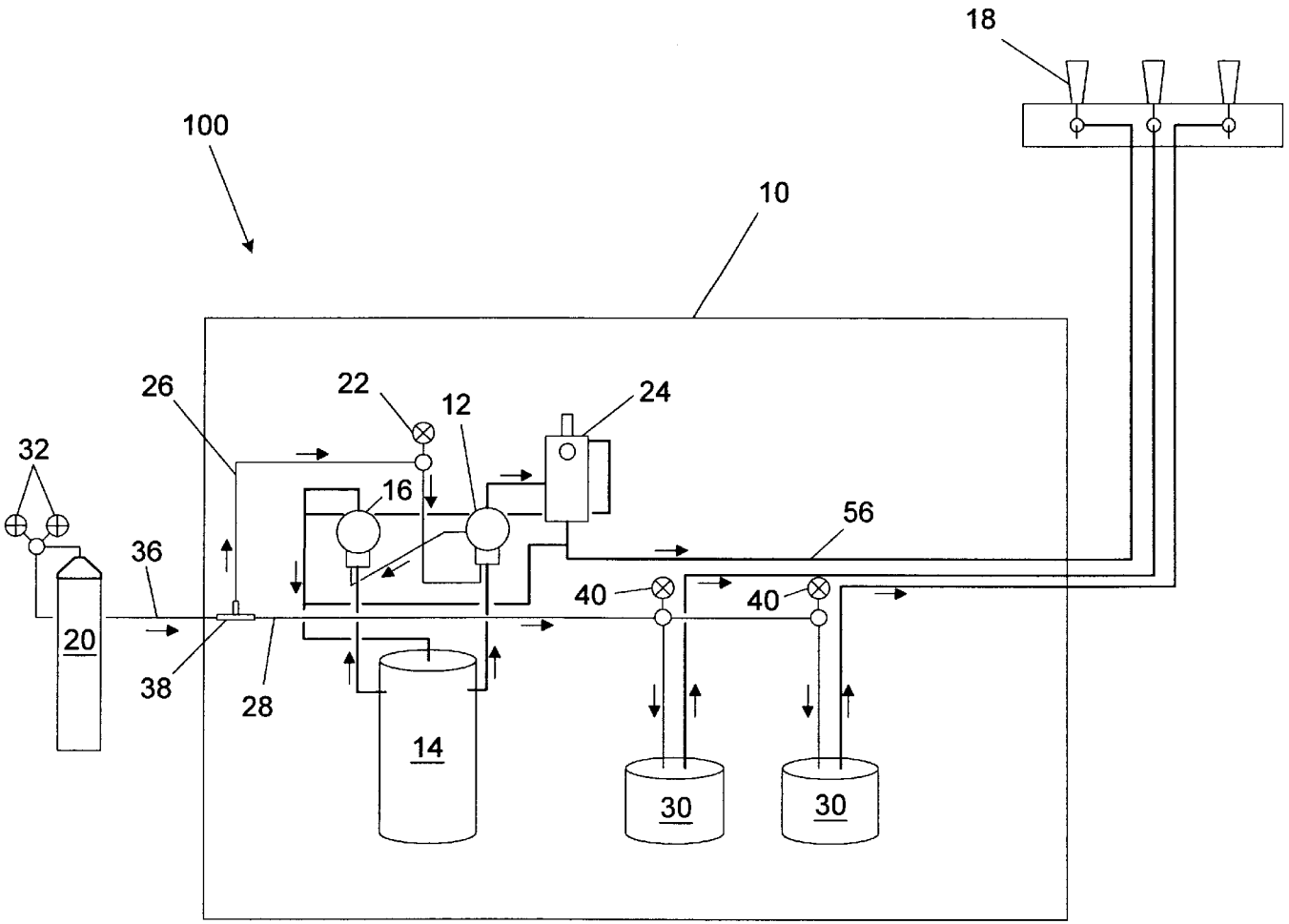
FIG. 2 is a schematic representation of a pressurized gas beverage dispensing system with a single regulator.

In an alternative embodiment illustrated in FIG. 2, the pressurized gas from the gas source 20 may be supplied to the pumps 12 and 16 from a single line 36 that may also supply the additional beverage containers 30. In this embodiment, line 36 may be connected to one of the regulator stations, e.g., regulator station 32. It can be understood that either of the regulator stations may be used with line 36. Line 36 may feed to a connection 38, where lines 26 and 28 are joined. From connection 38, lines 26 and 28 may be connected to regulator 22 and additional beverage containers 30, respectively, as shown for FIG. 1. In the embodiment of FIG. 2, separate regulators 40 may be provided at the additional beverage containers 30 to provide for differences in operating pressures between the pumps 12 and 16 and the additional beverage containers 30.

Figure 3:
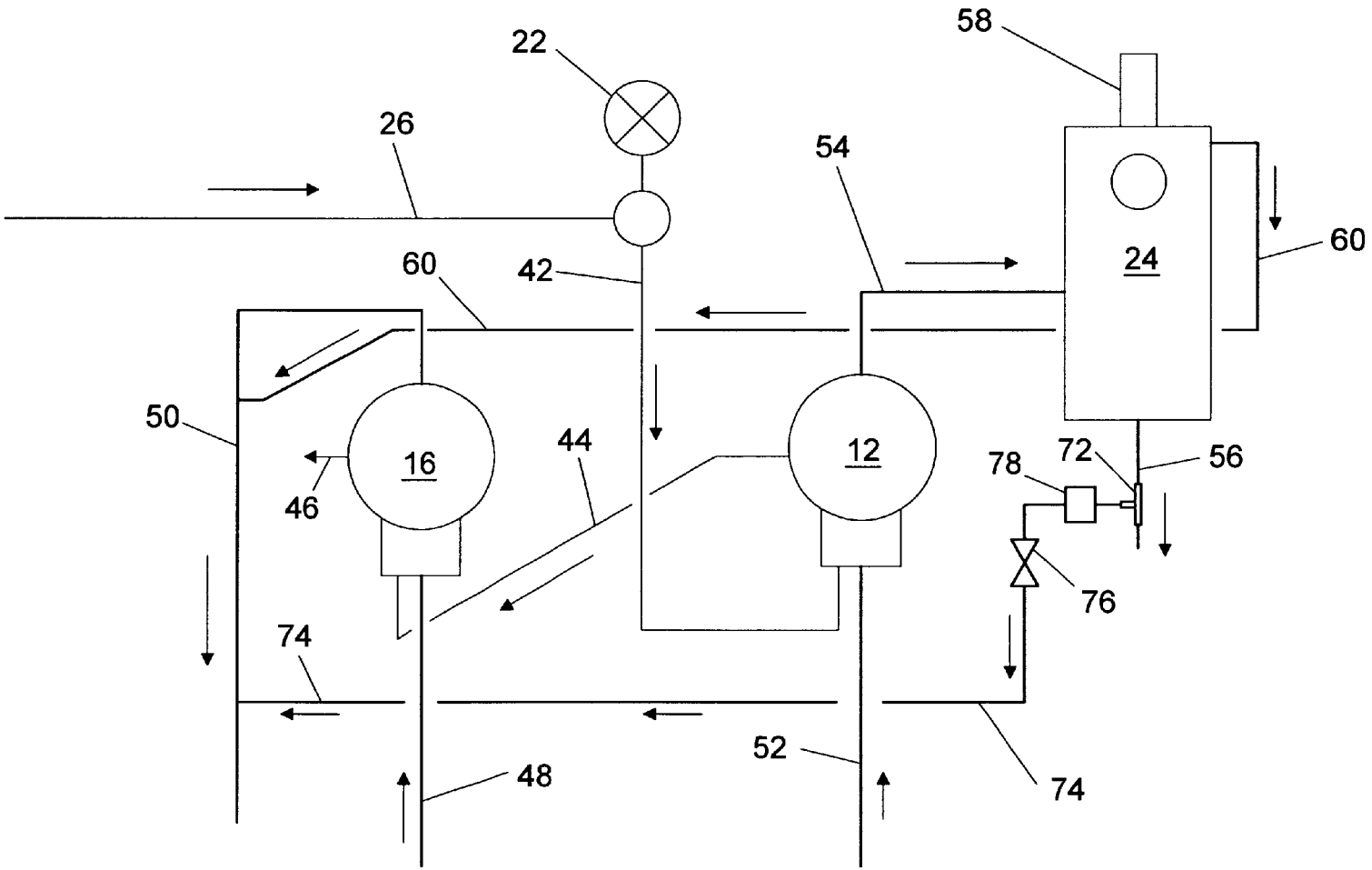
FIG. 3 is a piping schematic of the pumping system for the dispensing system.

Referring now to FIG. 3, there is shown a piping schematic at pumps 12 and 16, with arrows designating the direction of flow through the piping. Pressurized gas may flow from source 20 (shown in FIGS. 1 and 2) to regulator 22 in line 26. Regulator 22 may control the pressure of the pressurized gas to the pumps 12 and 16, as is known in the art. Regulated gas from regulator 22 may flow through line 42 to dispensing pump 12 to operate the pumping mechanism (not shown) of pump 12. Exhaust gas can be tapped from pump 12 at tap line 44 and may flow to pump 16 to operate the pumping mechanism of pump 16 (not shown). Exhaust gas from mixing pump 16 may be vented to the atmosphere as indicated by exhaust 46.

During pump 16 operation, beverage may flow from tank 14, through line 48, to pump 16 and back to tank 14 through line 50. Thus, pump 16 may serve to maintain consistency of the beverage by mixing the beverage, i.e., by circulating the beverage from the tank 14 to the pump 16 and returning to the tank 14. During pump 12 operation, beverage may flow from tank 14, through line 52, to pump 12, through line 54 to valve 24 and from valve 24, through line 56 to tap 18 for dispensing.

Figure 4:
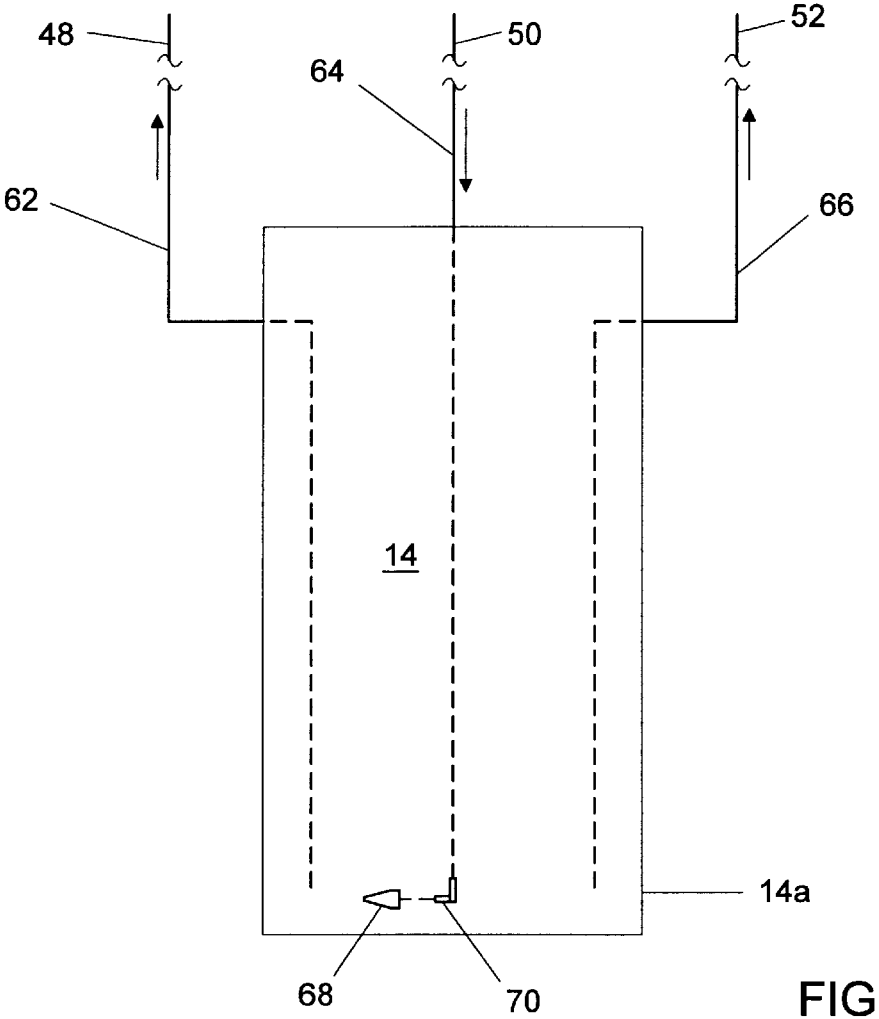
FIG. 4 is a piping schematic of the beverage container of the dispensing system.

FIG. 4 illustrates an embodiment of a storage tank 14 for use in the draft system 100. The storage tank 14 includes a mixing output line 62 that can be coupled to line 48 to deliver beverage for mixing to the mixing pump 16. The storage tank 14 also includes a mixing input line 64 that can couple to line 50 for delivering beverage from the mixing pump 16. In addition, the storage tank 14 can include a dispensing line 66 coupled to line 52 for delivering the beverage to the dispensing pump 12 for dispensing to the tap 18. Input line 64 may extend to bottom 14*a* of tank 14 and may terminate in a flow restriction, or nozzle 68. Nozzle 68 may serve to increase the velocity of the beverage returning to tank 14, so as to provide increased agitation and mixing. Nozzle 68 may be connected to input line 64 by a fitting 70, such as an elbow or the like, that may direct flow from nozzle 68 in a direction to further increase mixing or agitation within tank 14.

Referring back to FIGS. 1–3, when tap 18 is opened, the pressure drop in line 56 may allow pump 12 to operate to pump beverage from tank 14 to tap 18, as described and as known in the art. When tap 18 is closed, pressure in line 56 and at valve 24 may build to where pump 12 stops operating as may also be known in the art. In addition to the standard operation of pump 12, pump 12 may allow for the operation of pump 16. When pump 12 is operating, the exhaust gas from pump 12 is fed to pump 16 via line 44 to operate pump 16 to circulate, or mix the beverage in tank 14. Thus, freshly mixed beverage (resulting from the operation of pump 16) may be provided to tap 18 (resulting from the operation of pump 12). With pump 12 not operating, no exhaust gas is fed to pump 16, thus pump 16 ceases to operate. Valve 24 may be a ball valve, or the like, that may likewise stop operation of pumps 12 and 16 when tank 14 is empty.

In addition to activation of pumps 12 and 16 by opening spigot 18, pumps 12 and 16 can be activated at valve 24. By depressing bypass tab 58 on valve 24 (shown in FIG. 3), beverage can flow from valve 24, through line 60, to line 50 and back to tank 14. In a manner analogous to the operation of tap 18, depressing tab 58 may cause a pressure drop that can allow pump 12 to operate and consequently pump 16 can operate. In this instance, the beverage from pump 12 may return to tank 14 through line 60 as described.

The system 100 may further provide for automatic, or periodic, operation of pumps 12 and 16, such that the beverage can be agitated or mixed during periods when tap 18 is not opened and valve 24 is not manually operated. A fitting 72, such as a tee or Y, connects bleed line 74 to line 56. Bleed line 74 may be connected at an opposite end to line 50, or alternatively may discharge directly to tank 14. Needle valve, or other restrictor 76 is disposed in line 74, such that flow in line 74 downstream of needle valve 76, i.e., between needle valve 76 and tank 14, may not be under pressure. Fitting 72 may be mounted a distance above tank 14, such that the flow in line 74 downstream of needle valve 76 can be gravitational.

Pressure in line 56 may bleed small quantities of beverage through needle valve 76 and into tank 14. Over time, the loss of beverage from line 56 may cause the pressure in line 56 to drop to the point where pump 12 may begin operation, as previously described. Pump 12 may operate until pressure in line 56 is returned. The operation of pump 16, resulting from the operation of pump 12, may circulate the beverage in tank 14 as previously described. In this mode of operation, pump 16 may maintain the beverage at the proper consistency or mixture by periodically circulating, or mixing the contents of tank 14. Filter 78 may be disposed in line 74 between fitting 72 and valve 76 to trap large particles in the beverage to minimize clogging of needle valve 76. In the embodiment of FIG. 3, fitting 72 may be disposed in line 56. It can be understood that other placements of fitting 72 and line 74 may be appropriate, such as at line 54, depending on the operational characteristics of valve 24.

In a preferred embodiment, pump 16 may operate on the order of once in 15 minutes to mix or circulate the beverage in tank 14. Operating pressures for pumps 12 and 16 may be adjusted, or the bleed rate through valve 76 can be adjusted, or other parameters, or combinations of the same may be adjusted to increase or decrease mixing times as may be required for the beverage being dispensed.

While the systems and method have been disclosed in connection with the illustrated embodiments, various modifications and improvements thereon will become readily apparent to those skilled in the art. For example, the systems may be adapted for beverages other than mixed beverages, or may find use in dispensing slush or pulp type products that may require periodic mixing. It can also be seen that the systems described need not be part of an existing draft system, but may instead be a stand alone system. Additionally, multiple sets of pumps 12 and 16, storage tanks 14 and the components and piping described in relation to FIGS. 3 and 4 may be provided to dispense additional beverages.

Further, pumps may incorporate AC or DC electric motors, or other motive power, that may be controlled by pressure switches responding to the pressure drops within the lines. The operation of mixing pump 16 also may be controlled separately from dispensing pump 12. Additionally, mixing pump 16 may be in the form of an agitator, the operation thereof causing rotation of an agitating vane, or causing a gas to be bubbled through the beverage in the source. It may also be understood that the layout of components and piping may be changed to suit conditions encountered during installation. Accordingly, the spirit and scope of the present methods and systems is to be limited only by the following claims.

What is claimed is:

1. A system for dispensing a fluid product from a tap, comprising:

a dispensing pump in fluid communication with a source of the fluid product and the tap, wherein opening the tap operates the dispensing pump to pump the fluid product from the source to the tap; and a mixing pump in fluid communication with the source of the fluid product, wherein operation of the mixing pump circulates the fluid product from the source, through the mixing pump and back to the source;

wherein the dispensing pump and the mixing pump are operable by pressurized gas and exhaust gas from the dispensing pump operates the mixing pump.

2. The system of claim 1, comprising:

a pressurized gas source in fluid communication with the dispensing pump; and a regulator controlling the pressure of the pressurized gas to the dispensing pump from the pressurized gas source.

3. The system of claim 2, wherein time pressurized gas source is in fluid communication with a draft system for dispensing additional fluid products.

4. A system for dispensing a fluid product from a tap, comprising:

a dispensing pump in fluid communication with a source of the fluid product and the tap, wherein opening the tap operates the dispensing pump to pump the fluid product from the source to the tap;

a mixing pump in fluid communication with the source of the fluid product, wherein operation of the mixing pump circulates the fluid product from the source, through the mixing pump and back to the source;

a shut off valve disposed between and in fluid communication with the dispensing pump and the tap, the shut off valve stopping the operation of the dispensing pump and the mixing pump when the fluid product in the source falls below a predetermined level;

a bypass line in fluid connection between the shut off valve and the source of the fluid product; and a bypass tab operable to allow the fluid product to flow in the bypass line and to prevent flow to the tap, the flow causing operation of the dispensing pump and the mixing pump.

5. The system of claim 4, wherein the mixing pump and the dispensing pump are operable by pressurized gas.

6. The system of claim 5, comprising:

a pressurized gas source in fluid communication with the dispensing pump; and a regulator controlling the pressure of the pressurized gas to the dispensing pump from the pressurized gas source.

7. The system of claim 6, wherein the pressurized gas source is in fluid communication with a draft system for dispensing additional fluid products.

8. A system for dispensing a fluid product from a tap, comprising:

a dispensing pump in fluid communication with a source of the fluid product and the tap; wherein opening the tap operates the dispensing pump to pump the fluid product from the source to the tap;

a mixing pump in fluid communication with the source of the fluid product, wherein operation of the mixing pump circulates the fluid product from the source, through the mixing pump and back to the source; and a bleed line disposed between the dispensing pump and the tap to provide a controlled flow from an output port of the dispensing pump to the fluid product source, the controlled flow lowering a pressure at the output port to allow periodic operation of the dispensing pump and the mixing pump.

9. The system of claim 8, comprising a needle valve operating to provide the controlled flow.

10. The system of claim 9, comprising a filter disposed upstream of the needle valve.

11. A system for dispensing a fluid product from a tap, comprising:

a dispensing pump in fluid communication with a source of the fluid product and the tap, wherein opening the tap operates the dispensing pump to pump the fluid product from the source to the tap;

a mixing pump in fluid communication with the source of the fluid product, wherein operation of the mixing pump circulates the fluid product from the source, through the mixing pump and back to the source;

a return line connected between an output port of the mixing pump to the source of the fluid product; and a restrictor connected to an end of the return line within the source to increase a velocity of the fluid product returning to the source so as to facilitate mixing of the fluid product within the source.

12. A system for dispensing a fluid product from a tap, comprising:

a pressurized gas operated dispensing pump connected between a source of the fluid product and the tap, wherein opening the tap results in a pressure drop in a discharge line connecting the dispensing pump to the tap, the pressure drop operable to allow pressurized gas to operate the dispensing pump to pump the fluid product from the source to the tap; and a pressurized gas operated mixing pump connected to the source, wherein exhaust gas from the dispensing pump operates the mixing pump to circulate the fluid product from the source, through the mixing pump and back to the source.

13. A system for agitating a fluid product comprising:

a pressurized gas operated dispensing pump connected between a source of the fluid product and a discharge point of the fluid product;

a bleed line disposed between the dispensing pump and the discharge point to provide a controlled flow from an output port of the dispensing pump to the source, the controlled flow lowering a pressure at the output port to allow periodic operation of the dispensing pump to compensate for the lowering of the pressure; and a pressurized gas operated mixing pump connected to the source, wherein exhaust gas from the dispensing pump operates the mixing pump to agitate the fluid product within the source.

14. The system of claim 13, comprising a needle valve operating to provide the controlled flow.

15. The system of claim 14, comprising a filter disposed upstream of the needle valve.

16. A system for dispensing and mixing a fluid product, comprising:

a pressurized gas operated dispensing pump connected between a source of the fluid product and a discharge of the fluid product, wherein opening the discharge results in a pressure drop in a discharge line connecting the dispensing pump to the discharge, the pressure drop operable to allow pressurized gas to operate to dispensing pump to pump the fluid product from the source to the discharge;

a bleed line disposed between the dispensing pump and the discharge point to provide a controlled flow from an output port of the dispensing pump to the source, the controlled flow lowering a pressure at the output port to allow periodic operation of the dispensing pump to compensate for the lowering of the pressure;

a pressurized gas operated mixing pump connected to the source, wherein exhaust gas from the dispensing pump operates the mixing pump to circulate the fluid product from the source, through the mixing pump and back to the source to mix the fluid product; and a shut off valve disposed between the dispensing pump and the bleed line, the shut off valve stopping the operation of the dispensing pump when the fluid product in the source falls below a predetermined level.

17. A system for mixing a fluid product, comprising:

a pressurized gas operated dispensing pump connected between a source of the fluid product and a discharge point of the fluid product;

a shut off valve disposed between the dispensing pump and the discharge point, the shut off valve stopping the operation of the dispensing pump when the fluid product in the source falls below a predetermined level;

a bypass line in fluid connection between the shut off valve and the source of the fluid product;

a bypass tab operable to allow the fluid product to flow in the bypass line, the flow lowering a pressure at an output port of the dispensing pump to allow operation of the dispensing pump to pump fluid product from the source, through the bypass line and back to the source; and a pressurized gas operated mixing pump connected to the source, wherein exhaust gas from the dispensing pump operates the mixing pump to mix the fluid product within the source.

18. The system of claim 17, comprising:

a supply line from the source to the mixing pump; and a return line from the mixing pump to the source to facilitate mixing of the fluid product by the mixing pump operating to pump the fluid product from the source, through the supply line and back to the source through the return line.

* * * * *